US005619917A

United States Patent [19]

Takahira

[11] Patent Number: 5,619,917

[45] Date of Patent: Apr. 15, 1997

[54] STENCIL DISCHARGE APPARATUS

[75] Inventor: Shinichi Takahira, Ryugasaki, Japan

[73] Assignee: Riso Kagaku Corporation, Tokyo, Japan

[21] Appl. No.: 607,553

[22] Filed: Feb. 27, 1996

Related U.S. Application Data

[63] Continuation of Ser. No. 352,769, Dec. 2, 1994, abandoned.

[30] Foreign Application Priority Data

Dec. 6, 1993 [JP] Japan ..... 5-305435

[51] Int. Cl.[6] ..... B41L 13/04

[52] U.S. Cl. ..... 101/116; 101/477

[58] Field of Search ..... 101/114, 116–118, 101/128.4, 129, 477, 479; 400/625, 641

[56] References Cited

U.S. PATENT DOCUMENTS

| | | | |
|---|---|---|---|
| 4,241,911 | 12/1980 | Lee | 400/641 |
| 4,339,293 | 7/1982 | Takahashi et al. | 101/114 |
| 4,966,073 | 10/1990 | Hasegawa et al. | 101/120 |
| 5,048,416 | 9/1991 | Iijima | 101/115 |
| 5,215,394 | 6/1993 | Kim | 400/641 |

FOREIGN PATENT DOCUMENTS

| | | | |
|---|---|---|---|
| 4038675 | 6/1991 | Germany . | |
| 115882 | 7/1984 | Japan | 101/116 |
| 195885 | 8/1986 | Japan | 101/114 |
| 2069413 | 8/1981 | United Kingdom . | |
| 2238757 | 6/1991 | United Kingdom . | |

OTHER PUBLICATIONS

IBM Technical Disclosure Bulletin, vol. 30 No. 11, Apr. 1988, pp. 69–72, "Paper Exit Drive With Adjustable Paper Stacker".

*Primary Examiner*—Stephen R. Funk
*Attorney, Agent, or Firm*—Kanesaka & Takeuchi

[57] ABSTRACT

A stencil discharge apparatus includes two shafts mounted at a specific spacing; a plurality of rotators which are mounted in pairs on the two shafts, and rotate for gripping one end of a stencil paper to be removed from a printing drum and conveying the stencil paper thus removed; a receiving section for holding the stencil paper removed from the printing drum and conveyed by the pairs of rotators; and a different-diameter rotator mounted on both ends of at least one of the two shafts. The different-diameter rotator includes small-diameter portion having approximately the same outside diameter as the outside diameter of one rotator, and a large-diameter portion having a larger outside diameter than the small-diameter portion in order to prevent the stencil paper from going in between the different-diameter rotator and the shaft of the other rotator rotating in engagement with the one rotator.

11 Claims, 6 Drawing Sheets

STENCIL DISCHARGE APPARATUS

CROSS REFERENCE TO RELATED APPLICATION

This is a continuation application of Ser. No. 08/352,769 filed on Dec. 2, 1994, now abandoned.

BACKGROUND OF THE INVENTION

1. Field of the Invention

The present invention relates to a stencil discharge apparatus for removing a stencil wrapped on a stencil mounting member such as a printing cylinder of a mimeograph equipment, and adhered thereto by ink.

2. Description of the Related Art

Generally in a mimeograph equipment, an ink supply means is provided inside of a drum, and a mimeograph stencil paper can be wrapped around the outer peripheral surface of a circumferential wall which is pervious to ink. The stencil is adhered on the wall by ink. To discard a used stencil paper, generally a stencil discharge means comprising stripping pawls, a pair of discharge rollers, and a stencil receiving box is provided in the vicinity of the drum.

That is, the spent stencil paper is released, with its one end gripped by the stripping pawls in accordance with the rotation of the printing drum, from the surface of the printing drum by means of a pair of discharge rollers, and then is pushed for discharging directly into the stencil receiving box.

In FIG. 6 when a stencil paper is taken into the stencil receiving box by means of an upper roller 31 and a lower roller 32 which constitute a discharge roller pair 33, it becomes necessary to prevent the used stencil paper to be discharged from rolling back onto the discharge roller. For this purpose, in addition to the rollers of the discharge roller pair 33, a guide member comprising an upper guide plate 34 and a lower guide plate 35 is provided.

If a gap between the upper and lower guide members is set narrow, an increased load will be required to convey the used stencil paper by the discharger roller pair, giving an adverse effect to the used stencil discharging operation of the discharge roller pair. Therefore, between the upper and lower guide members there must be provided a certain degree of gap.

The discharge apparatus, however, has the following problem that where a certain degree of gap is formed between the upper and lower guide members as described above, the rear end corner portion 37 of stencil paper 36 in the vicinity of the discharge roller pair enters between the upper and lower guide members, jutting out on the entrance side of the discharge roller pair, or on the printing drum side as shown in FIG. 6. If, in this state, the stencil discharging operation is done, the leading end 38 of the stencil paper 40 that has been fed out from the printing drum is disturbed to enter into the discharge roller pair by the corner portion 37 of the preceding stencil paper 36 as shown in FIG. 7. Therefore, the entrance of both side portions 38 corresponding to the corner portions 37 of the stencil paper 40 into the discharge roller pair delays, and the whole part of the stencil paper is drawn into the rollers at center, and is discharged into the receiving box 39, resulting in an increased protruding amount of the corner portions 37 and finally in a failure in discharging the used stencil paper.

And also the discharge apparatus has the following problem that when the receiving box 39 has become full to some extent of thus discarded stencil paper, the stencil paper 40 being newly discharged will be affected by the stencil paper 36 present in the vicinity of the discharge roller pair 33, and .the corner portion 37 of the stencil paper will jut out from between the upper and lower guide plates 34 and 35 near the rollers located at both end rollers, disturbing the entrance of the corner portion 38 of the following stencil paper into the discharge rollers 33 and finally resulting in a failure in stencil discharge.

The above-described problems can be solved by providing a compressing mechanism for squeezing used stencil paper, which has been taken into the receiving box by the discharge roller pair, and a secondary operation (elevator compression or other) within the receiving box. Addition of a complicated mechanism, however, will increase the number of parts, which will present another problem such as an increase in cost.

Furthermore, the adoption of the aforementioned method will also increase the number of processes necessary for conveyance and compression of the used stencil paper discharged, increasing a possibility of occurrence of a trouble during the process.

Furthermore, it is also considered to mount the discharge roller pair in positions corresponding to the overall width of the stencil paper to be conveyed. However, the use of these discharge rollers will cause rolling the front end corners of the discharged stencil paper into a space between thee roller and the guide plate provided in other part except the rollers. That is, the front end corners of the stencil paper must be left free. The aforesaid construction, therefore, is not desirable.

SUMMARY OF THE INVENTION

In view of the above-described various problems inherent in the heretofore known art, it is a first object of the present invention to provide a stencil discharge apparatus, which comprises two shafts mounted at a specific spacing, a plurality of rotators which are mounted in pairs on the two shafts, and rotate for gripping one end of the stencil paper and carrying the stencil paper stripped off from the printing drum, a receiving section for containing the stencil paper removed from the printing drum and carried by the pairs of rotators, and a different-diameter rotator mounted on either end of at least one of the two shafts mounted with one pair of rotators, said different-diameter rotator including a small-diameter portion having approximately the same outside diameter as the outside diameter of one rotator, and a large-diameter portion having a larger outside diameter than the small-diameter portion in order to prevent the stencil paper from going in between said different-diameter rotator and the shaft of the other rotator rotating in engagement with the one rotator.

It is a second object of the present invention to provide a stencil discharge apparatus as stated in the first object, in which guide members are mounted between the shafts of the plurality of rotators mounted in pairs.

It is a third object of the present invention to provide a stencil discharge apparatus as stated in the first object, in which the outside diameter of the small-diameter portion is not larger than the outside diameter of one rotator and the large-diameter portion has a peripheral surface having an outside diameter which is not in contact with the shaft of the other rotator.

It is a fourth object of the present invention to provide a stencil discharge apparatus as stated in the first object, in which the outside diameter of the small-diameter portion is not larger than the outside diameter of one rotator, and the large-diameter portion is a member which elastically deforms in Contact with the shaft of the other rotator.

It is a fifth object of the present invention to provide a stencil discharge apparatus, which comprises a stencil discharge section having a plurality of pairs of driving rotators and driven rotators which are mounted in pairs on two shafts disposed at a specific spacing and are rotated in engagement with each other to hold one end of a stencil paper to be removed from the printing drum and conveyed, a guide section including an upper guide member and a lower guide member for guiding the stencil paper, a receiving box for receiving the stencil paper removed from the printing drum, and a different-diameter rotator which includes a small-diameter portion having approximately the same outside diameter as the outside diameter of the driving rotator and a large-diameter portion having a larger outside diameter than the small-diameter portion to thereby prevent the entrance of the stencil paper between the upper guide member and the large-diameter portion, and coax jelly mounted as the driving rotator.

It is a sixth object of the present invention to provide a stencil discharge apparatus comprising a stencil discharge section having a plurality of pairs of driving rotators and driven rotators which are mounted in pairs on two shafts disposed at a specific spacing and are rotated in engagement with each other to hold one end of a stencil paper to be removed from the printing drum and conveyed, a guide section including an upper guide member and a lower guide member for guiding the stencil paper, a receiving box for receiving the stencil paper removed from the printing drum, and a different-diameter rotator which includes a small-diameter portion having approximately the same outside diameter as the outside diameter of the driven rotator and a large-diameter portion having a larger outside diameter than the small-diameter portion to thereby prevent the entrance of the stencil paper between the lower guide member and the large-diameter portion, and coaxially mounted as the driven rotator.

The rear end of the stencil paper discarded into the receiving section, particularly a corner portion not applied with ink, tends to extend with a force of recovery, protruding out from the discharge side towards the incoming side of the discharging rotator. If the rotator stops in a position where the large-diameter portion of the rotator having different diameters faces the guide member, the gap between the guide members will be closed with the large-diameter portion, thereby preventing the rear end of the stencil paper from protruding out towards the incoming side. Furthermore, if the different-diameter rotator stops in such a position where the small-diameter portion faces the guide member, there will be formed a gap between the small-diameter portion and the guide member. However, the different-diameter rotator will rotate to force the stencil paper back into the receiving box when the subsequent discharging operation begins even if the rear end of the stencil paper has appeared back out to the incoming side through this gap, and consequently no adverse effect will be given to the stencil paper subsequently discharged.

These and other objects, features and advantages of the present invention will become more apparent upon a reading of the following description and accompanying drawings.

DETAILED DESCRIPTION OF THE PREFERRED EMBODIMENTS

The first embodiment of the present invention will now be described by referring to FIGS. 1 to 4.

Figure 1:
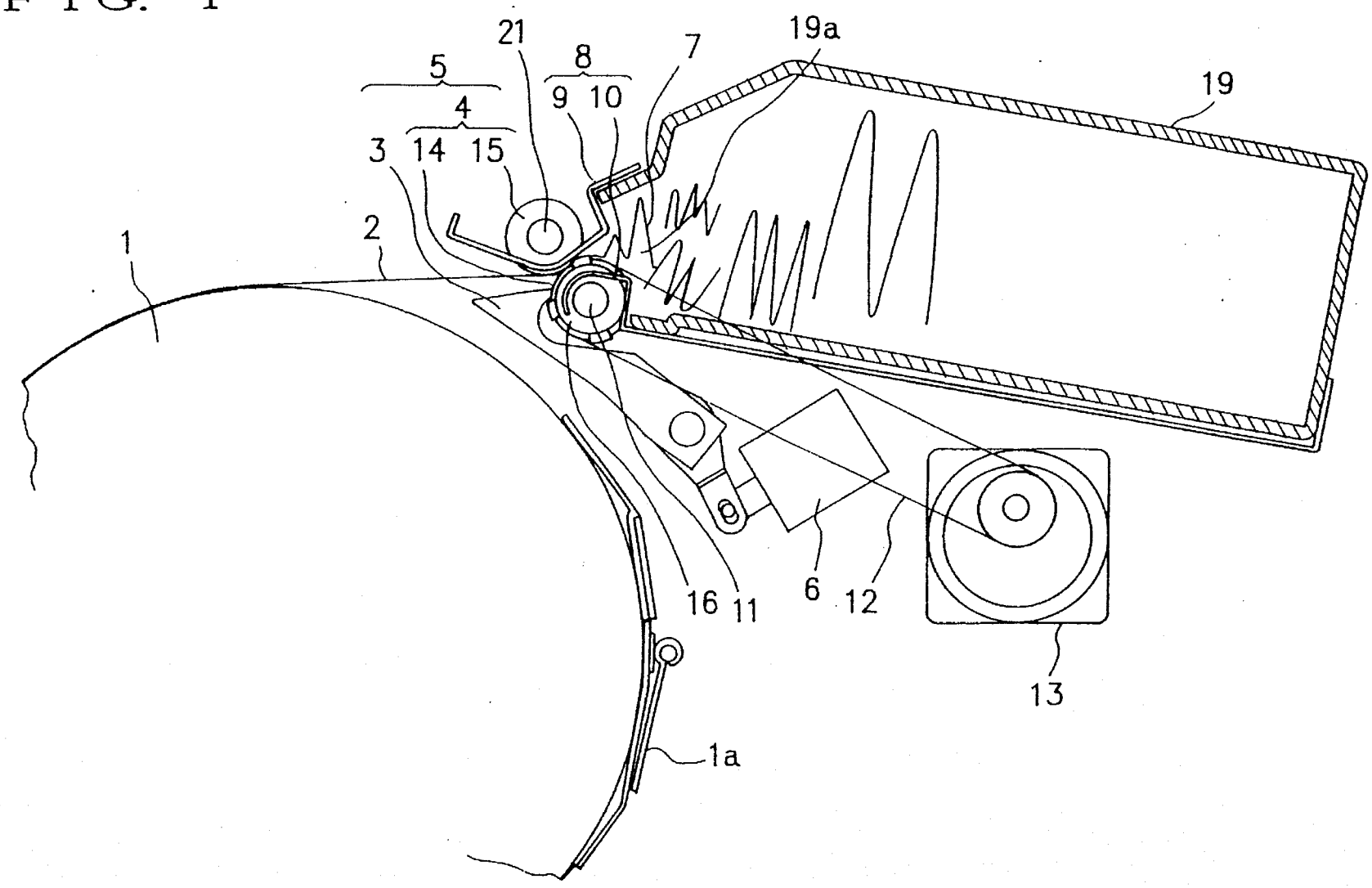
FIG. 1 is a sectional view schematically showing the construction of a stencil discharge apparatus of a first embodiment according to the present invention.

In FIG. 1, a reference numeral 1 is a cylindrical printing drum which is driven to rotate around the center axis thereof not illustrated. On the outer peripheral surface of the printing drum 1 is mounted a clamp plate 1*a* which is a stencil locking means mounted in parallel with a generatrix of the outer peripheral surface. The stencil paper is fixed at the leading end with the clamp plate 1*a* and wrapped around the outer peripheral surface of the printing drum 1. A part of the peripheral surface of the printing drum 1 corresponding to a printing area is permeable to ink. Inside the printing drum 1 is provided an in, supply means which is not shown.

Adjacently to the printing drum 1 is mounted a stencil stripping means 5 near the outer peripheral surface of the printing drum 1. The stencil stripping means 5 has a stripping pawl 3 and a stencil discharge section 4. The stripping pawl 3 is driven by means of a solenoid 6 to strip with its tip a leading end 7 of a stencil paper 2 from the outer peripheral surface of the printing drum 1, then guiding the stencil paper to the stencil discharge section 4.

The stencil discharge section 4 has a lower roller 14 serving as a driving rotator mounted on a shaft 11 and an upper roller 15 serving as a driven rotator mounted on a shaft 21. The shafts 21 and 11 and the upper and lower rollers 15 and 14 mounted on the shafts 21 and 11 are set in parallel with the printing drum. The lower roller 14 is driven to rotate by an endless belt 12. The upper roller 15 is designed to rotate with the rotation of the lower roller 14. The peripheral speed of rotation of the lower roller 14 is set higher than the printing drum speed for the purpose of giving a specific tension to the stencil paper being conveyed by the rotation of the printing drum.

Figure 2A:
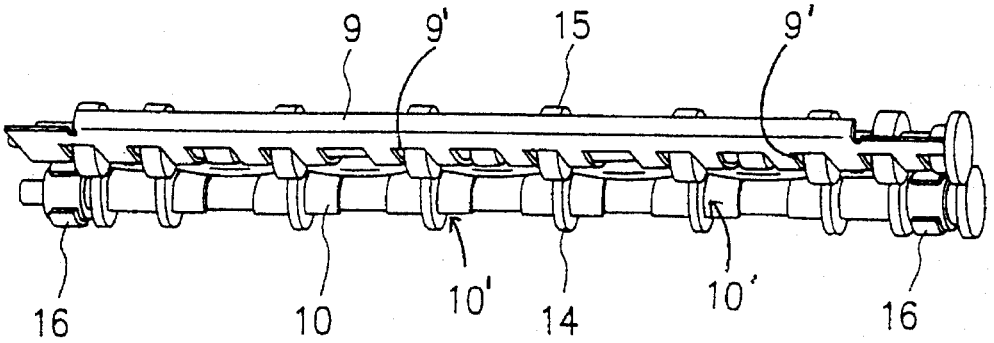
FIG. 2 (*a*) is a perspective view schematically showing a major portion of the first embodiment according to the present invention, and FIG. 2 (*b*) is a sectional view of the same.
Figure 2B:
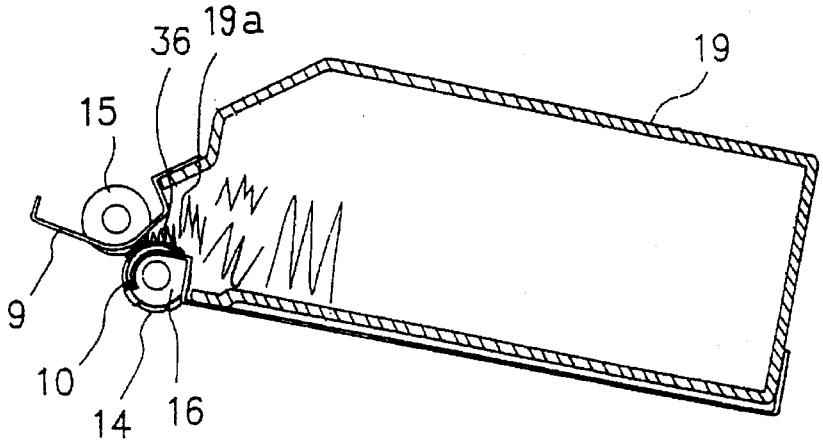

A guide section 8 consists of an upper guide plate 9 as an upper guide member and a lower guide plate 10 as a lower guide member. As shown in FIG. 2(*a*), the rollers 15 extend through notches 9' in the upper guide plate 9, and the rollers 14 extend through notches 10' in the lower guide plate 10. The upper and lower guide plates 9 and 10 are so mounted vertically at a specific spacing between the rollers of the stencil discharge section 4 as to close a space in the axial direction of the rollers and are so constructed as to prevent the stencil paper 2 from being caught between the rollers. If the gap between the upper guide plate 9 and the lower guide plate 10 is narrow, the guide plate 9 or 10 provides load to the stencil paper 2 being conveyed, and therefore is set to such a small amount that the load will not be applied parallel to the shaft 11 of the lower roller 14 of the stencil discharge section 4.

The leading end 7 of the stencil paper 2 stripped off from the printing drum 1 by means of the stripping pawl 3 is gripped and pulled by the upper and lower rollers 14 and 15 of the stencil discharge section 4. The stencil paper 2 guided by the upper and lower guide plates 9 and 10 of the guide member 8, is carried by the upper and lower rollers 14 and 15 and is removed from the printing drum 1.

Figure 4:
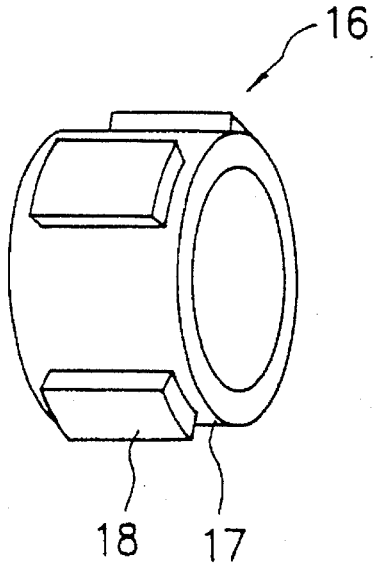
FIG. 4 is a perspective view showing the shape of a different-diameter roller of the first embodiment according to the present invention.

In the stencil discharge section 4, the shaft 11 mounted with the lower roller 14 has, on both outermost end portions, different-diameter rollers 16 which are different-diameter rotators having the configuration shown in FIG. 4. The different-diameter roller 16 has a small-diameter portion 17 including a peripheral surface of approximately the same diameter as the lower roller 14. In the present embodiment, the outside diameter of the small-diameter portion 17 is a little smaller than the outside diameter of the lower roller 14.

The different-diameter roller 16 has a large diameter portion larger than the outside diameter of the small-diameter portion 17, and the large-diameter portion 18 includes a peripheral surface having such an outside diameter that will not contact the upper guide plate 9. The large-diameter portion 18 is disposed at a specific spacing in the circumferential direction on the peripheral surface constituting the small-diameter portion 17 as shown in FIG. 4.

Two positions where the different-diameter rollers 16 are mounted are on the shaft 11 of the lower roller 14, and correspond to both end portions in the direction of width of the stencil paper being conveyed as shown in FIG. 2 (*a*). These positions are the positions where non-inked rear end corner portions 37 of the stencil paper discarded into the receiving box will come out on the entrance side.

Figure 3:
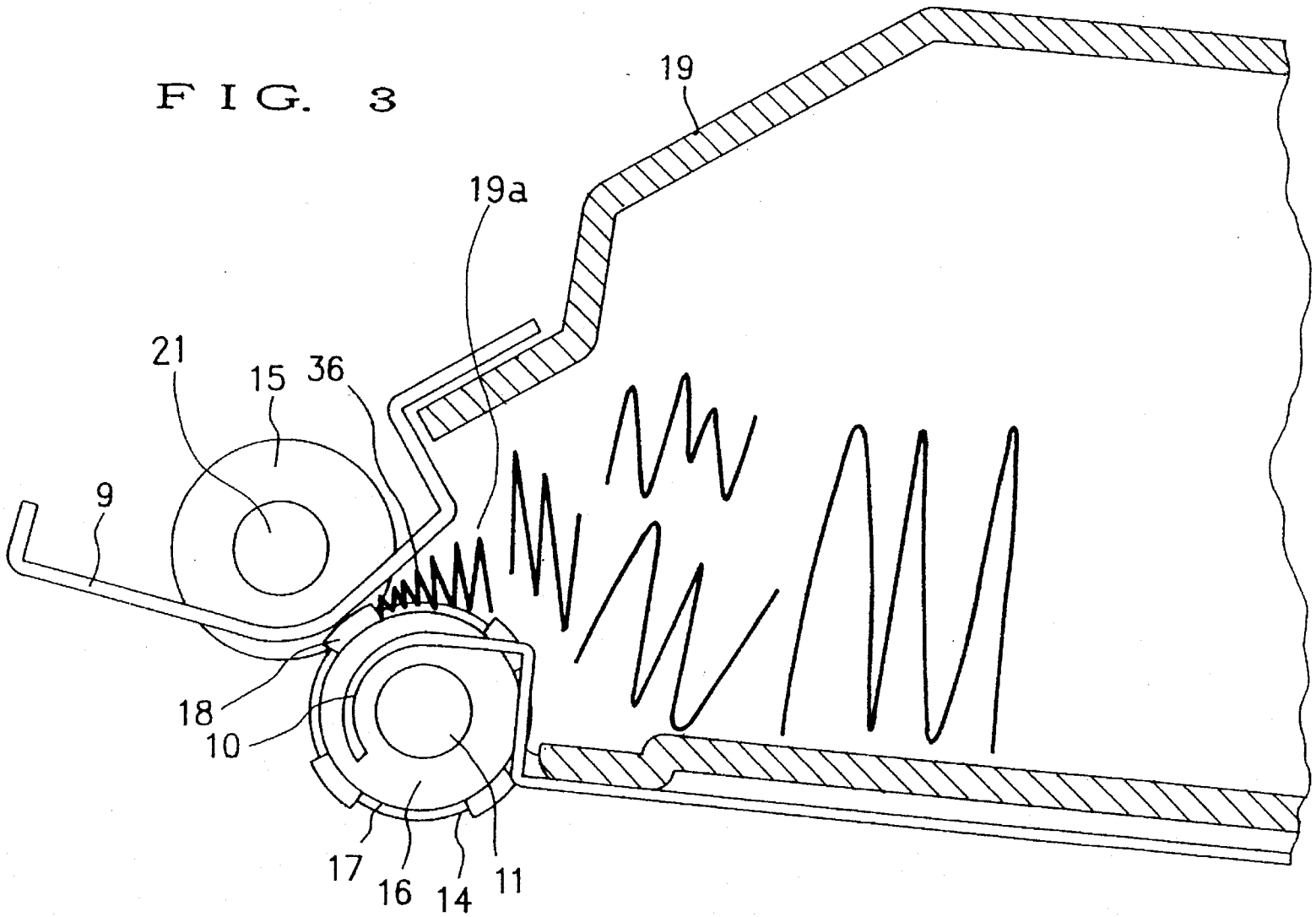
FIG. 3 is a partly enlarged view of FIG. 2 (*b*)

FIG. 3 is an enlarged view of a major portion of FIG. 2 (*b*). since the large-diameter portion 18 of the different-diameter roller 16 closes a gap between the lower roller 14 and the upper guide plate 9, the stencil paper 36 discarded Will not go in and out on the printing drum side.

In FIG. 1, the stencil paper 2 which approaches the stencil discharge section 4 with the rotation of the printing drum 1 is applied with a downward force first before it reaches a contact point (nip section) of the upper and lower rollers 14 and 15 of the stencil discharge section 4, drooping towards the stripping paw 3. However, according to the present embodiment, because the large-diameter portion 18 of the different-diameter roller 16 mounted on the same axis as the lower roller 14 which is rotating works as if hitting the stencil paper 2 upwardly, the stencil paper 2 can exactly reach the contact point (nip section) of the upper and lower rollers 14 and 15 of the stencil discharge section 4.

Furthermore, the material of the different-diameter roller 16 to be used in the present embodiment is a material, such as a plastics material, which has a lubricous surface. For example, if rubber is used, the stencil paper 2 is attracted towards the lower roller 14 which is a driving roller, and is easily rolled into the space between the lower guide plate 10 and the lower roller 14.

Adjacently to the stencil discharge section 4 and the guide section 8 is mounted the spent stencil receiving box 19 as a receiving section for receiving stencils discarded. A receiving port 19*a* provided in the front end of the spent stencil receiving box 19 is opened on the outlet side of the guide section 8; and the stencil paper 2 stripped from the printing drum 1 by the stencil discharge section 4 is guided by the guide section 8, and is sent into the spent stencil receiving box 19.

Next, operation and function of the stencil discharge apparatus of the above-described constitution will be explained.

The clamp plate 1*a* is opened to free the leading end portion of the stencil paper wrapped around the printing drum. The upper and lower rollers 14 and 15 of the stencil discharge section begin to rotate and at the same time the stripping pawl 3 turns to a stripping position from a standby position.

The printing drum 1 rotates clockwise in FIG. 1, so that the leading end of the stencil paper being held at a fixed level will be guided from the drum surface by a spring plate not shown on the printing drum 1, to the contact point (nip position) of the upper and lower rollers 14 and 15 of the stencil discharge section 4 by the stripping pawl 3.

The stencil paper 2 on the printing drum 1 is pulled taut, and is removed from the printing drum 1 by the upper and lower rollers 14 and 15 of the stencil discharge section 4 which are rotating at a higher speed than the peripheral speed of the printing drum 1. Then the stencil paper 2 is guided and carried by the guide member a until it is fully stripped from the printing drum 1 and led into the spent stencil receiving box 19.

At this time, the stencil paper 2 carried by the stencil discharge section 4 is pressed, while crashing, against a preceding stencil paper discharged immediately before the stencil paper 2 and present in the vicinity of the stencil discharge section 4 in the spent stencil receiving box 19. The stencil paper, therefore, is squeezed compactly into a shape of bellows. A first stencil paper, when discharged into the stencil receiving box 19 which is empty, will be squeezed into the form of bellows by a compressing means such as a compression plate not shown mounted in the spent stencil receiving box 19.

When the stencil paper 2 is conveyed by the stencil discharge section 4, the rear end corner portion of the stencil paper 2 is taken into the spent stencil receiving box 19 without applying load to the upper and lower rollers 14 and 15 of the stencil discharge section 4, by the operation of the different-diameter roller 16 which, secured coaxially on the lower roller, is rotating together with the lower roller.

After the upper and lower rollers 14 and 15 of the stencil discharge section 4 stop to finish the stencil discharge operation, the rear end corner portion of the thus discarded stencil paper 2 where no ink has been applied tends to expand with the force of recovery from the folded state like bellows. At this time, when the lower roller 14 stopped in a condition that the gap between the large-diameter portion 18 of the different-diameter roller 16 and the upper guide plate 9 is closed, the rear end corner portion of the stencil paper 2 will not go out towards the entrance side from the spent stencil receiving box 19 side. The stencil paper 2, if going out to the entrance side when the lower roller 14 is at a stop in the position where the gap is present, will be pushed back to the spent stencil receiving box 19 side by the different-diameter roller 16 with the rotation of the stencil discharge section 4 in the subsequent stencil discharge operation.

Figure 5:
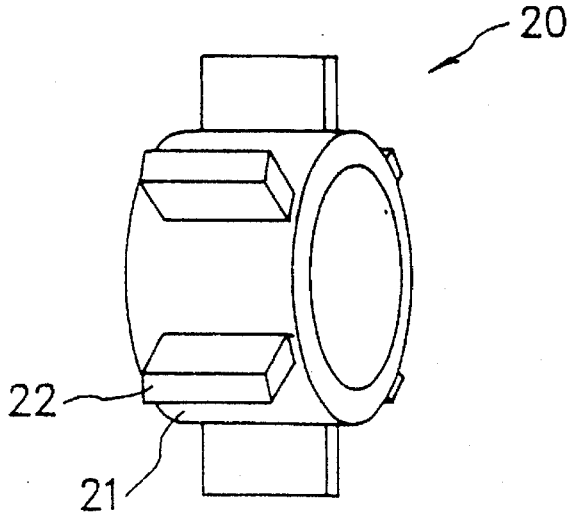
FIG. 5 is a perspective view showing the shape of a different-diameter roller of a second embodiment.
Figure 6A:
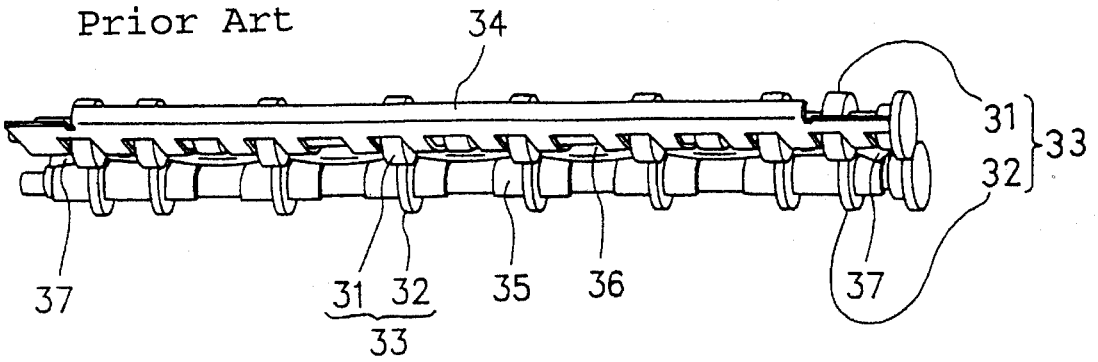
FIG. 6(a) Prior Art
FIG. 6 (*a*) is a perspective view schematically showing a major portion of a prior art example, and FIG. 6 (*b*) is a sectional view of the same.
Figure 6B:
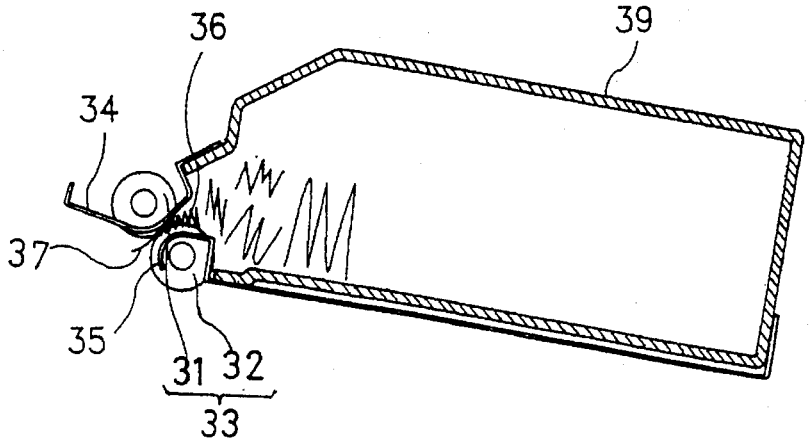
FIG. 6(b) Prior Art
Figure 7A:
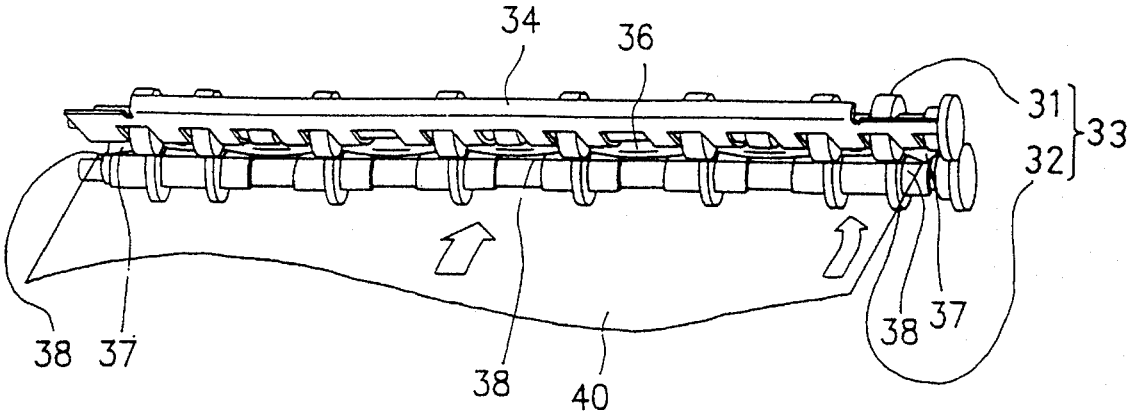
FIG. 7(a) Prior Art
FIG. 7 (*a*) is a perspective view schematically showing a major portion of the prior art example, and FIG. 7 (*b*) is a sectional view of the same.
Figure 7B:
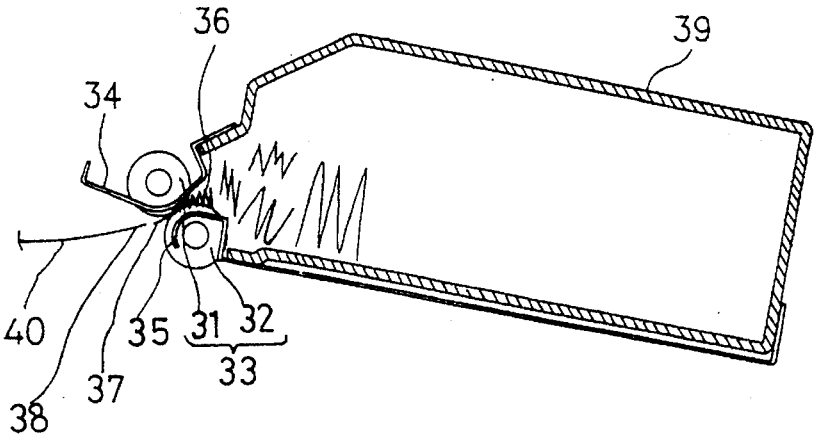
FIG. 7(b) Prior Art

FIG. 5 shows a different-diameter roller 20 in the second embodiment of the present invention. The different-diameter roller 20 of the present embodiment is mounted on both ends of the shaft 11 of the lower roller 14 like that of the first embodiment. A small-diameter portion 21 has approximately the same outside diameter as the lower roller 14 which is a driven roller; in the present embodiment, the outside diameter of the small-diameter portion 21 is set a little smaller than the outside diameter of the lower roller.

The outside diameter of a large-diameter portion 22 is set to the degree that it contacts the upper guide plate 9 when the different-diameter roller 20 has rotated. That is, a radius of a circle drawn by the forward end of the large-diameter portion 22 when the different-diameter roller 20 has rotated is longer than the distance between the center of the shaft 11 and the upper guide plate 9. Also, the height of the large-diameter portion 22 is longer than the distance between the small-diameter portion 21 and the upper guide plate 9.

In the present embodiment, the large-diameter portion 22 of the different-diameter roller 20 is formed of an elastic material. And therefore when the different-diameter roller 20 has rotated, the large-diameter portion 22 contacts the upper guide plate 9, thereby being elastically deformed. Accordingly, the stencil paper 2 can be conveyed by the different-diameter roller 20 from between the upper and lower guide plates 9 and 10 without disturbing the rotation of the different-diameter roller 20.

According to the different-diameter roller 20 of the above-described constitution, when the roller 20 has stopped rotating with the large-diameter portion 22 in contact with the upper guide plate 9, the large-diameter portion 22 elastically deforms to exactly close the gap between the roller and the upper guide plate 9. Therefore the rear end portion of the stencil paper discarded can be prevented from protruding out backwardly from between the upper guide plate 8 and the roller of the discharge section. When the large-diameter portion 22 is stopped away from the upper guide plate 9 and the stencil paper discarded protrudes out backwardly from between the roller of the stencil discharge section and the guide plate, the stencil paper can be discharged into the receiving box after being conveyed between the roller and the guide section in the subsequent conveying operation. At this time, the large-diameter portion 22 of the different-diameter roller 20 warps elastically, catching the stencil paper between the different-diameter roller and the upper guide plate 9 to thereby carry out the conveyance and discharge operation reliably.

In each of the above-described embodiments, the different-diameter rollers are mounted on the shaft 11 of the lower roller 14, one on each end in the direction of width intersecting at right angles with the direction of travel of the stencil paper. However, the different-diameter roller may be mounted on the shaft of the upper roller and also a plurality of different-diameter rollers may be mounted on optional positions on the shaft.

In each of the above-described embodiments have been exemplified two cases that the large-diameter portion of the different-diameter roller contacts a corresponding guide member or not. In either case, it is desirable that the stencil discharge apparatus have such a constitution that the large-diameter portion of the different-diameter roller of the present invention can prevent the stencils paper received in the receiving box from protruding out on the entrance side when the large-diameter portion is at a stop to face the corresponding guide member, and, furthermore, that the stencil paper, if appearing from the guide section, be forced back towards the receiving section side by driving the different-diameter roller.

It is, therefore, possible to use a brush member or the like which elastically contacts the corresponding guide member, as the large-diameter portion of the different-diameter roller which has the above-described function.

The stencil paper removing device of the present invention has the following advantage that there is adopted a different-diameter roller having large- and small-diameter portions in the stencil discharge section provided with a pair of discharge rollers, whereby the backward movement of the discarded stencil paper towards the entrance side can be prevented; or the stencil paper, if appearing out on the entrance side, will be forced into the discharge side reliably by the subsequent discharge operation, thus stabilizing the discharge of used stencil paper by this type of stencil paper removing device to thereby remarkably improve its function.

It is further understood by those skilled in the art that the foregoing description is the preferred embodiments of the disclosed device and that various changes and modifications may be made in the invention without departing from the spirit and scope thereof.

What is claimed is:

1. A combination comprising a stencil discharge apparatus, a stencil with side ends and lateral end portions arranged on both sides of the side ends, and a printing drum, said stencil discharge apparatus discharging the stencil mounted on the printing drum and comprising:

two shafts arranged at a predetermined distance away from each other and situated near and parallel to the printing drum, a plurality of rotators mounted in pairs on said two shafts, said rotators, when rotated, gripping one of the side ends of the stencil to remove the stencil from the printing drum and carrying the stencil therefrom, a receiving section situated near the shafts for receiving the stencil removed from the printing drum and carried by the rotators, and different-diameter rotators mounted on both ends of one of said two shafts outside the rotators and facing the lateral end portions of the stencil disposed on the printing drum in a direction of width of the stencil to be conveyed, each different-diameter rotator including a small diameter portion having an outside diameter not larger than that of one of the rotators, and a large-diameter portion having an outside diameter larger than that of the small-diameter portion and less than a distance to the shaft facing thereto, said small and large diameter portions having sections alternately arranged on an outer surface of the different-diameter rotator so that the lateral end portions of the removed stencil do not remain on the different-diameter rotators when a subsequent stencil is newly discharged into the receiving section.

2. A combination according to claim 1, further comprising guide members mounted between said shafts for guiding the stencil therebetween.

3. A combination according to claim 2, wherein said outside diameter of the large diameter portion has a size such that the large-diameter portion does not contact an opposing guide member.

4. A combination according to claim 3, wherein said sections of the large diameter portion are equally spaced apart from each other, a circumferential length of said section of the large diameter portion being less than that of the section of the small diameter portion.

5. A combination according to claim 4, wherein an axial length of said section of the large diameter portion is less than that of the section of the small diameter portion.

6. A combination according to claim 1, wherein said different-diameter rotator is made of a material having a lubricous surface to reduce adhering of the stencil to the different-diameter rotator.

7. A combination according to claim 1, further comprising a guide section including an upper guide member and a lower guide member for guiding the stencil from the printing drum to the receiving section, said upper and lower guide members having notches and being situated between the two shafts such that the rotators are located in the notches, said different diameter rotators facing one of the upper and lower guide members disposed opposite thereto and said outside diameter of the large-diameter portion having a distance nearly contacting said one of the upper and lower guide members.

8. A combination according to claim 1, wherein said different-diameter rotators have sizes such that the large-diameter portions operate to surely push the lateral end portions of the stencil removed from the printing drum into the receiving box without gripping the stencil when the stencil is removed from the printing drum.

9. A combination comprising a stencil discharge apparatus, a stencil with side ends and lateral end portions arranged on both sides of the side ends and a printing drum, said stencil discharge apparatus discharging the stencil mounted on the printing drum and comprising:

a stencil discharge section including two shafts arranged at a predetermined distance away from each other and situated near and parallel to the printing drum, and a plurality of pairs of driving rotators and driven rotators mounted on said two shafts, said rotators, when rotated, gripping one of the side ends of the stencil to remove the stencil from the printing drum and carrying the stencil therefrom, a guide section including an upper guide member and a lower guide member for guiding the stencil from the printing drum to the stencil discharge section, said upper and lower guide members having notches and being situated between the two shafts such that the driving and driven rotators are located in the notches, a receiving box situated near the stencil discharge section for receiving the stencil removed from the printing drum and carried by the rotators, and different-diameter rotators mounted on both ends of one of said two shafts outside the driving and driven rotators and facing the lateral end portions of the stencil disposed on the printing drum in a direction of width of the stencil to be conveyed, each different-diameter rotator including a small diameter portion having an outside diameter substantially same as an outside diameter of one of the driving and driven rotators, and a large-diameter portion having an outside diameter larger than that of the small-diameter portion and less than a distance to one of the upper and lower guide members facing thereto, said small and large diameter portions having sections alternately arranged on an outer surface of the different-diameter rotator so that the lateral end portions of the removed stencil do not remain on the different-diameter rotators when a subsequent stencil is newly discharged into the receiving box.

10. A combination according to claim 9, wherein said sections of the large diameter portion are equally spaced apart from each other, a circumferential length of said section of the large diameter portion being less than that of the section of the small diameter portion, and an axial length of said section of the large diameter portion being less than that of the section of the small diameter portion.

11. A combination according to claim 9, wherein said different-diameter rotator is made of a material having a lubricous surface.

* * * * *